US005104168A

United States Patent [19]

Magee

[11] Patent Number: 5,104,168

[45] Date of Patent: Apr. 14, 1992

[54] HAND TABLE AND CARRYING RACK

[76] Inventor: Charles Magee, Rte. 3, Box 895, Fort Valley, Ga. 31030

[21] Appl. No.: 700,256

[22] Filed: May 15, 1991

Related U.S. Application Data

[62] Division of Ser. No. 437,091, Nov. 16, 1989, Pat. No. 5,062,674.

[51] Int. Cl.[5] ..... A47G 23/06

[52] U.S. Cl. ..... 294/143; 206/558; 206/563; 211/71; 294/144; 294/146

[58] Field of Search ..... 294/141-144, 294/146, 159-161, 165, 167, 170, 172; 206/557, 558, 562-564; 211/41, 71-74, 88, 126, 133; 220/23.2-23.86; 248/311.2, 316.8

[56] References Cited

U.S. PATENT DOCUMENTS

| | | | |
|---|---|---|---|
| D. 227,851 | 7/1973 | Nowland | 294/159 |
| 1,167,934 | 1/1916 | Roth | 294/143 |
| 1,258,792 | 3/1918 | Lorimer | 248/311.2 |
| 2,029,535 | 2/1936 | Langel | 294/160 |
| 2,080,865 | 5/1937 | Lassiter | 294/143 X |
| 2,295,860 | 9/1942 | Oliver | 294/172 |
| 2,302,446 | 11/1942 | Kincaid | 294/172 X |
| 2,354,968 | 8/1944 | Pickering | 294/27.1 |
| 2,967,622 | 1/1961 | Poglein et al. | 294/143 X |
| 3,142,425 | 7/1969 | Cobb | 294/172 |
| 3,164,257 | 1/1965 | Foy | 294/143 |
| 3,768,710 | 10/1973 | Eggers | 294/159 |
| 4,516,685 | 5/1985 | French | 220/23.83 |
| 4,607,758 | 8/1986 | Stevens | 220/23.83 |
| 4,744,597 | 5/1988 | Bauman | 294/172 |

*Primary Examiner*—Johnny D. Cherry

*Attorney, Agent, or Firm*—Roylance, Abrams, Berdo & Goodman

[57] ABSTRACT

A hand table for carrying a plate and a cup includes an upper support and a lower support. The upper support has a generally circular plate support and a cup or glass receiving opening. The lower support is coupled to the upper support and has a generally inverted U-shaped handle portion with a bight and depending legs. A pair of foot members extend outwardly from the legs of the handle portion for supporting the upper and lower supports on a surface, such as a table. A cup support extends from one of the foot members to a position directly below the cup opening in the upper support, to underlie a cup or glass bottom. A carrying rack for supporting plates and cups includes a platform portion, a base portion coupled to the platform portion, a plurality of cup supports coupled to the platform portion, and a plurality of hand tables releasably coupled to the platform portion. The platform portion includes a hub, a plurality of support arms extending radially from the hub, and at least one side dish support on each support arm.

12 Claims, 5 Drawing Sheets

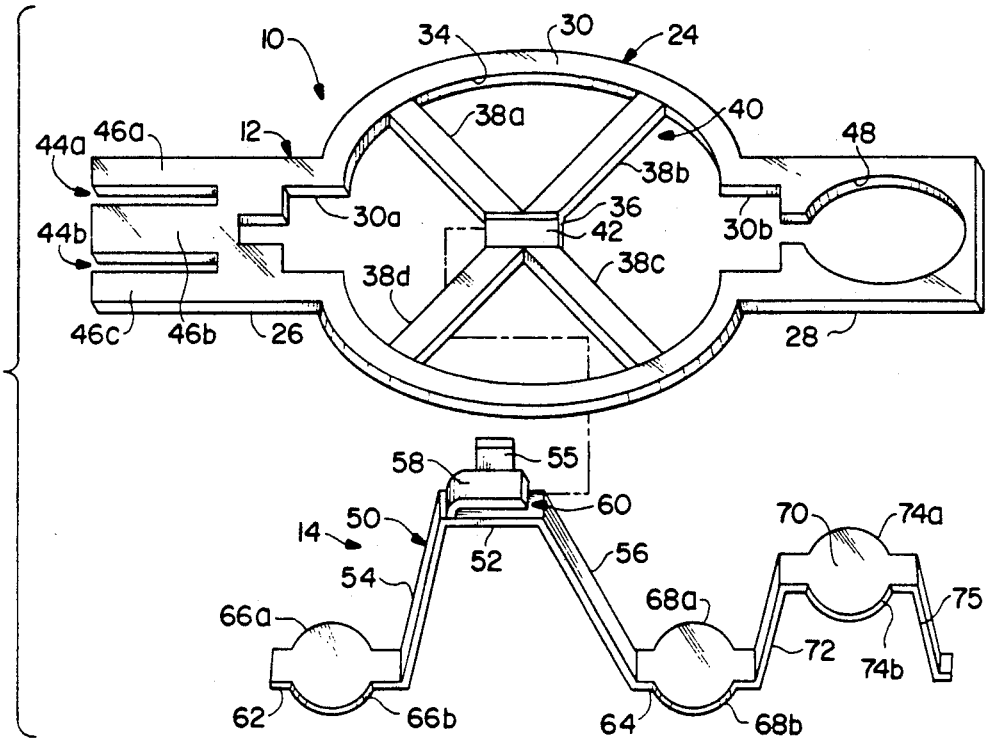
FIG.1
FIG. 2
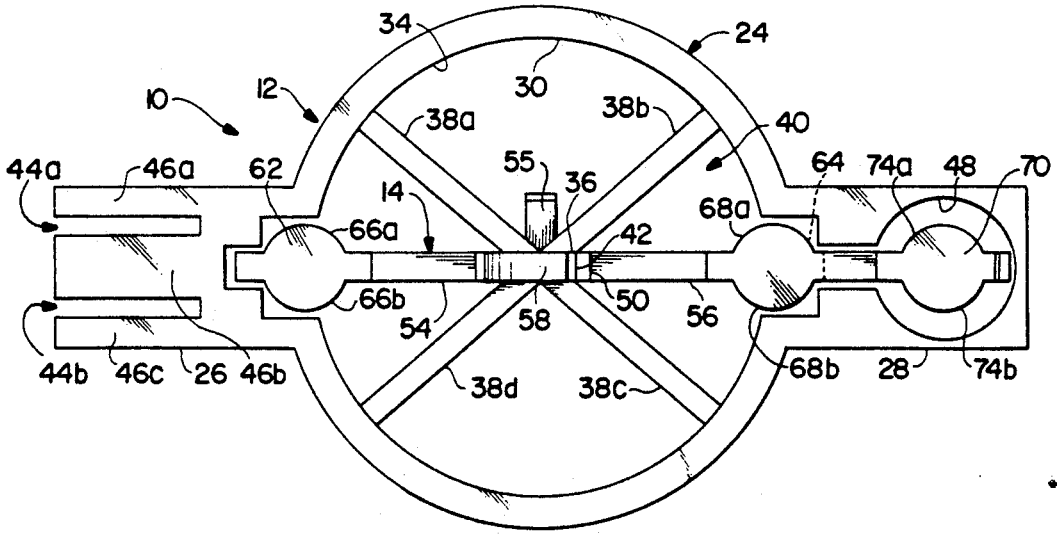

FIG. 3
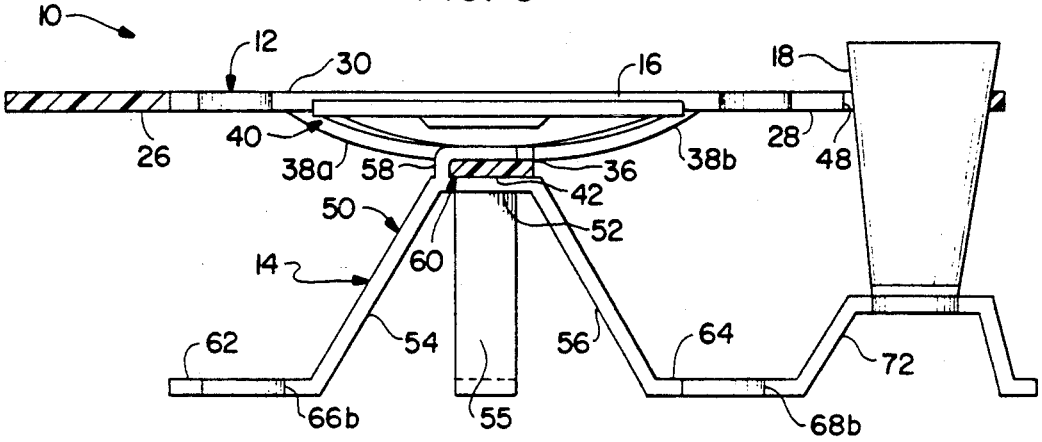
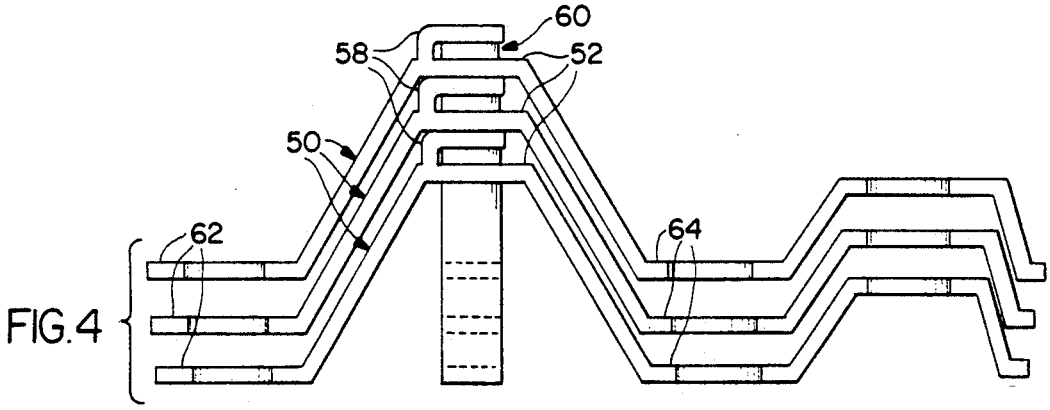
FIG.4
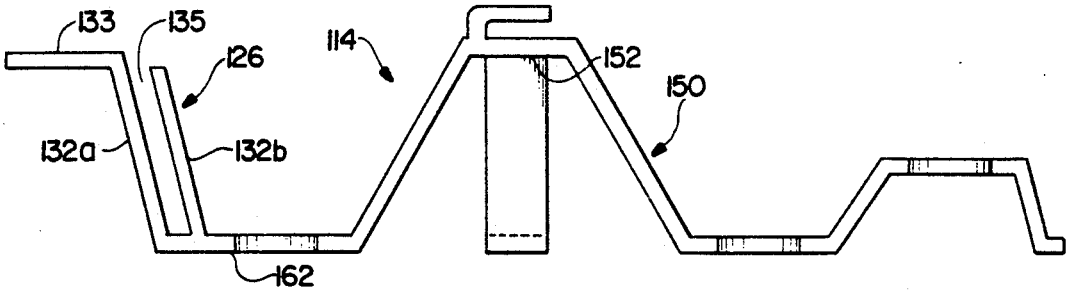
FIG. 5

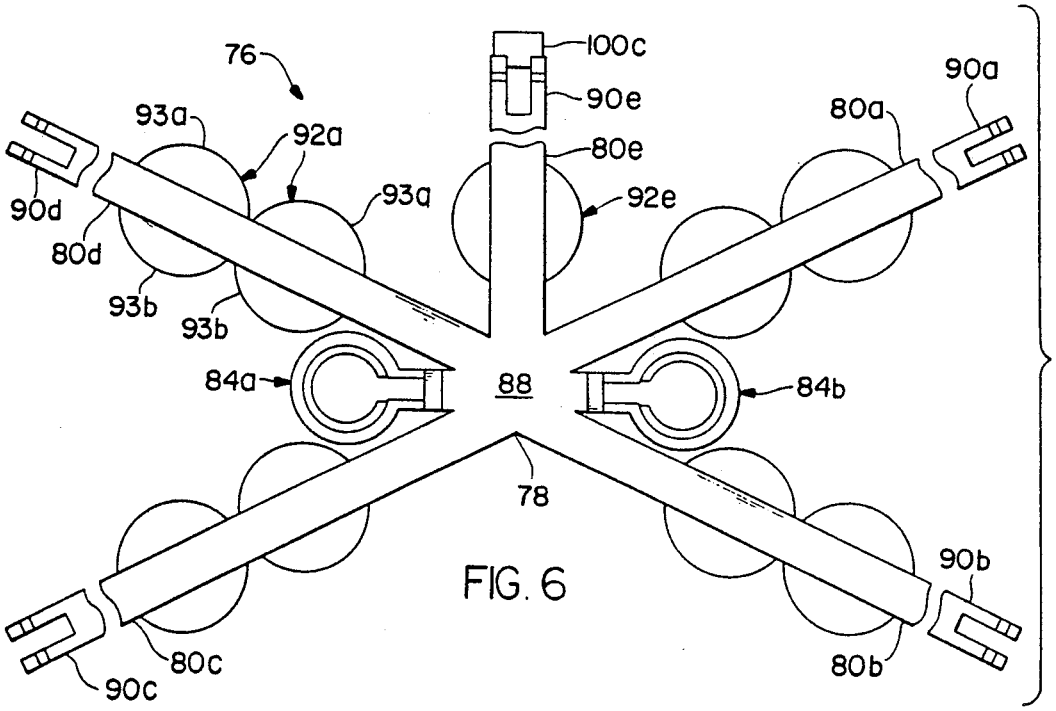
FIG. 6
FIG. 7
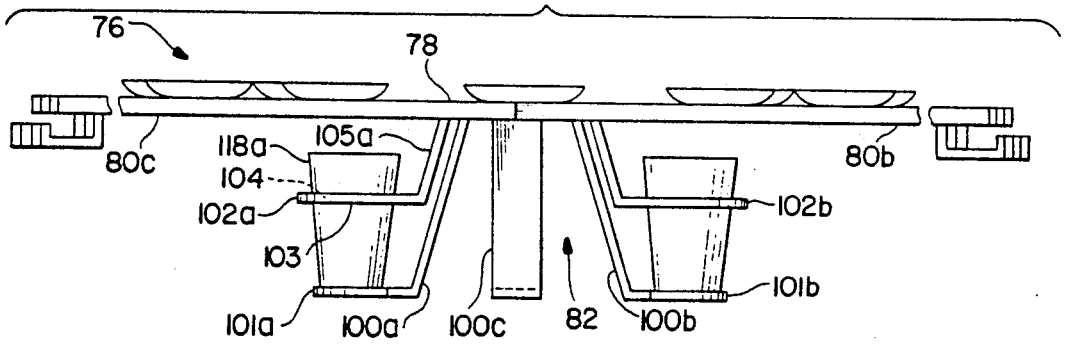
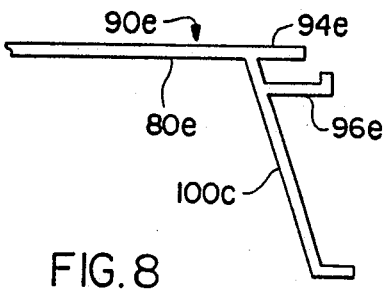
FIG. 8
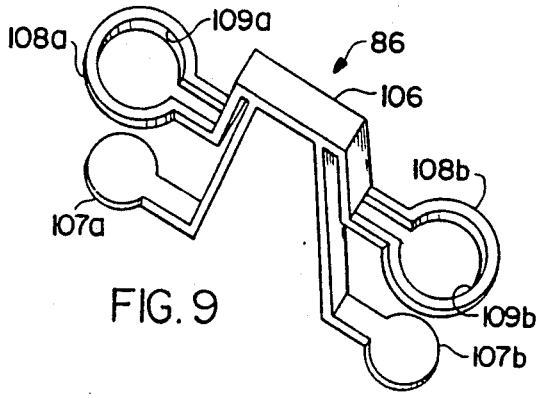
FIG. 9

FIG. 10
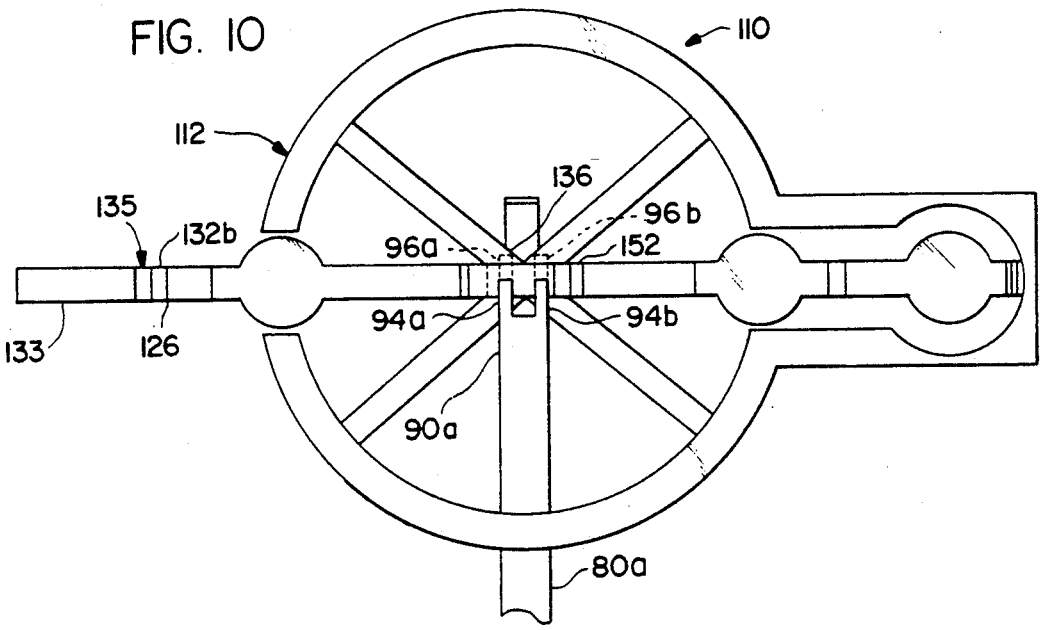
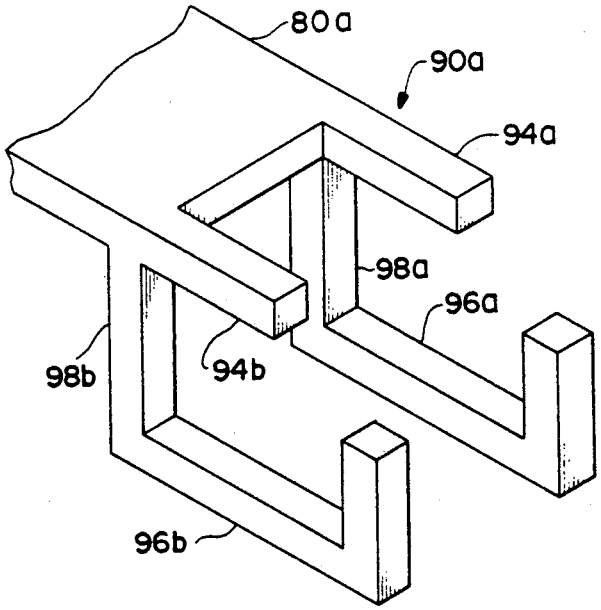
FIG. 11
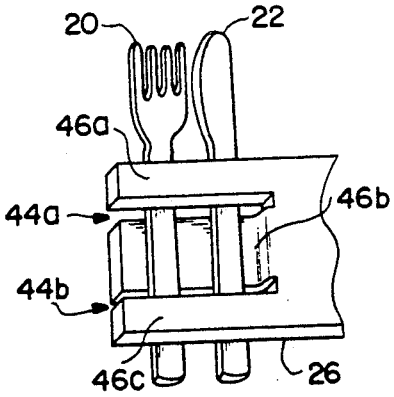
FIG. 12

HAND TABLE AND CARRYING RACK

This is a division of application Ser. No. 07/437,091 filed Nov. 16, 1989 now U.S. Pat. No. 5,062,674.

FIELD OF THE INVENTION

The present invention relates to a hand table or tables and a carrying rack for supporting plates, bowls and cups. In particular, each hand table provides a convenient way to carry a plate of food, side dishes and at least one drink in a cup or glass with one hand, while leaving the other hand free for eating and drinking. The carrying rack supports a plurality of hand tables allowing a server to carry in one hand a plurality of hand tables with plates of food, several drinks in cups and numerous side dishes.

BACKGROUND OF THE INVENTION

A common practice at parties, receptions, and other business and social functions involves eating while standing. Holding both a plate and a cup while eating, drinking and/or holding a conversation in a crowded room is both difficult and cumbersome. Normally, a glass cannot be placed on the plate because of the presence of food. Even if this were possible, spilling the glass' contents readily occurs. Invariably people walk around the room searching for a place to set their plates and/or cups down. Further, children and adults spill food and drinks when carrying a plate of food and a drink in a cup from a serving line to a sitting place.

Moreover, waitresses or waiters have a difficult time carrying more than two complete servings at one time. Accordingly, a rack is needed that will allow the waiter or waitress to carry twice as many servings in a significantly more comfortable and stable position.

Numerous devices for holding food, cups and utensils are disclosed in U.S. Pat. Nos. 1,258,792 to Lorimer; 2,295,860 to Oliver; 2,354,968 to Pickering; 3,142,425 to Cobb; 3,768,710 to Eggers; 4,516,685 to French; 4,607,758 to Stevens; 4,744,597 to Bauman et al; and Des. 227,851 to Nowland et al.

SUMMARY OF THE INVENTION

Accordingly, an object of the present invention is to provide a hand table for carrying a plate of food, a side dish and a drink in a cup in one hand while leaving the other hand free for eating and drinking.

A further object of the present invention is to provide a hand table that is inexpensive and easy to manufacture.

Another object of the present invention is to provide a hand table for carrying a plate of food, several side dishes and two drinks in cups or glasses in one hand, while leaving the other hand free for eating and drinking.

Another object of the present invention is to provide a hand table that can be easily stacked.

A still further object of the present invention is to provide a hand table for supporting utensils, such as a knife, a fork and a spoon.

Yet another object of the present invention is to provide a carrying rack for supporting a plurality of plates, bowls and cups, and/or hand tables.

The foregoing objects are basically obtained by a hand table(s) including an upper support and a lower support coupled to the upper support. The upper support has a generally circular plate support and a cup opening or side dish opening. The lower support has a generally inverted U-shaped handle portion with a bight and first and second legs depending from the bight. A pair of foot members extend outwardly from the legs of the handle portion for supporting the upper and lower supports on a surface. A cup(s) support extends outwardly from one of the foot members and is positioned below the cup opening in the upper support for supporting the bottom of a cup or glass.

The foregoing objects are also obtained by a carrying rack including a platform portion, a base portion coupled to the platform portion, a plurality of cup supports coupled to the platform portion, and a plurality of hand tables releasably coupled to the platform portion. The platform portion includes a hub, a plurality of support arms extending radially from the hub, and at least one side dish support coupled along each of the support arms. The base portion is coupled to the platform portion for supporting the platform portion above a surface. The cup supports are coupled to the platform portion between pairs of adjacent support arms. Each of the support arms includes a connecting member for coupling one of the hand tables to the free end of the respective support arm.

Other objects, advantages and salient features of the invention will become apparent from the following detailed description, which, taken in conjunction with the annexed drawings, discloses several preferred embodiments of the invention.

BRIEF DESCRIPTION OF THE DRAWINGS

FIG. 1 is a perspective view of a hand table with its upper support exploded above its lower support in accordance with a first embodiment of the present invention;

FIG. 2 is a top plan view of the hand table of FIG. 1 with its supports coupled;

FIG. 3 is a side elevational view in partial section of the hand table of FIG. 2;

FIG. 4 is a side elevational view of a plurality of lower supports of FIGS. 1–3 in a stacked position;

FIG. 5 is a side elevational view of a lower support having a utensil holder for a hand table in accordance with a second embodiment of the present invention;

FIG. 6 is a top plan view of a carrying rack in accordance with the present invention;

FIG. 7 is a side elevational view of the carrying rack of FIG. 6 with a pair of cups positioned within its cup supports;

FIG. 8 is a partial, end elevational view of one of the support arms of the carrying rack of FIGS. 6 and 7;

FIG. 9 is a perspective view of a cup assembly that can be removably coupled to the support arms of the carrying rack of FIGS. 6–8;

FIG. 10 is a top plan view of the hand table of FIG. 5 coupled to one of the support arms of the carrying rack of FIGS. 6–8;

FIG. 11 is an enlarged, partial, perspective view of a free end of one of the support arms of the carrying rack of FIGS. 6–8;

FIG. 12 is a partial, perspective view of a utensil holder of the hand table of FIGS. 1–4;

DETAILED DESCRIPTION OF THE INVENTION

Figure 13:
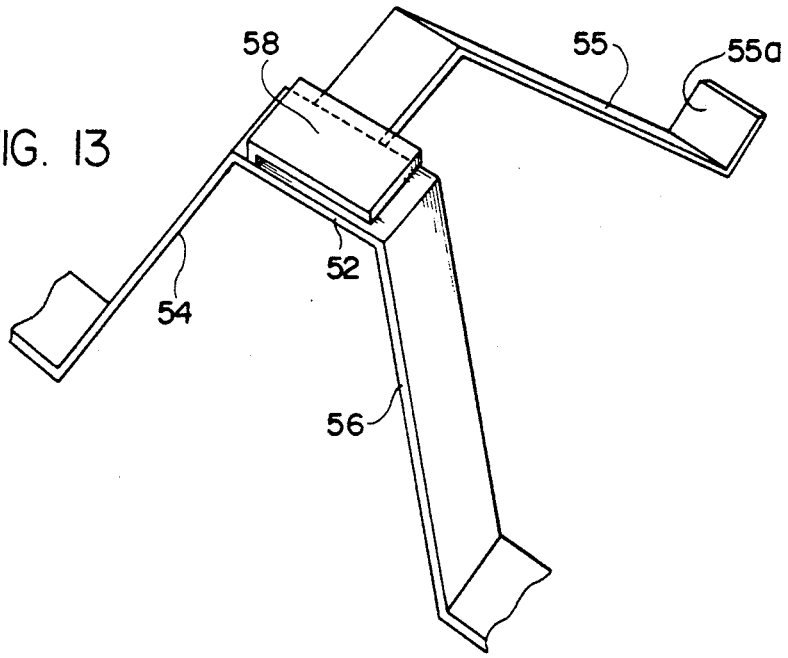
FIG. 13 is a partial perspective view of the lower support of FIG. 1, particularly illustrating the third leg.

Referring initially to FIGS. 1-3, a hand table 10 in accordance with the present invention includes an upper support 12 and a lower support 14 releasably coupled to upper support 12. Preferably, both the upper and lower supports 12 and 14 are made of a plastic material having sufficient rigidity to support a plate 16 and a cup or glass 18 as seen in FIG. 3, yet sufficiently flexible and resilient to releasably couple utensils 20 and 22 to upper support 12 as seen in FIG. 12.

Upper support 12 includes a generally circular plate support 24 having a utensil holder 26 integrally formed therewith and extending horizontally therefrom. An upper cup support 28 is also integrally formed with and extends horizontally from plate support 24, directly opposite utensil holder 26.

Plate support 24 has a generally planar and annular rim portion or member 30 surrounding an opening 34, and a hub member 36 positioned in the center of opening 34 and coupled to rim portion 30 by four spokes or ribs 38*a*-38*d*. Spokes 38*a*-38*d* are curved and extend generally radially from hub member 36 to form an upwardly concave plate supporting area 40. Spokes 38*a*-38*d* could be replaced with a solid upwardly concaved bowl. Hub member 36 is recessed downwardly from spokes 38*a*-38*d* to form a rectangular recessed plate 42.

Diametrically opposite openings 30*a* and 30*b* are formed in the upper support. Openings 30 and 30*b* permit lower support 14 to pass directly through the upper support, improving stacking of the hand tables.

Utensil holder 26 is a generally rectangular planar member having two slots 44*a* and 44*b* extending from its free end inwardly toward plate support 24. Slots 44*a* and 44*b* form three flexible tabs 46*a*-46*c* which may be deflected upwardly or downwardly for retaining utensils 20 and 22 therein as seen in FIG. 12.

Upper cup support 28 is a generally rectangular planar portion having a cup opening 48 extending therethrough for receiving cup 18 as seen in FIG. 3. Opening 48 is generally circular although other shapes may be used depending on the shape of the glass or cup being used.

Lower support 14 includes a generally inverted U-shaped handle portion 50 having a bight 52 with a pair of legs 54 and 56 extending downwardly and outwardly therefrom. Bight 52 and legs 54 and 56 are all preferably rectangular planar portions. A third leg 55 also extends downwardly and outwardly from bight 52, and is generally perpendicular to and between legs 54 and 56. Bight 52 has an L-shaped clip member 58 extending upwardly therefrom to form a connecting slot 60 between bight 52 and the long portion of the L-shaped clip member 58. Connecting slot 60 is sized to slidably receive and frictionally retain plate 42 of hub member 36 therein as particularly seen in FIG. 3.

Legs 54, 55 and 56 have outwardly extending foot members 62, 55*a* and 64, respectively, coupled thereto to support lower support 14 on a surface, such as a table. Foot member 62 includes a pair of semicircular flanges 66*a* and 66*b* for added stability when hand table 10 is supported on a surface. Foot member 64 likewise has a pair of semicircular flanges 68*a* and 68*b*.

A lower cup support 70 is fixedly coupled to foot member 64 by an extension member 72 for positioning lower cup support 70 directly below cup opening 48 to support and engage the bottom of cup 18 thereon as seen in FIG. 3. Lower cup support 70 includes a pair of semicircular flanges 74*a* and 74*b* for supporting the bottom of cup 18 and a depending support leg 75 at its outer end to support a filled cup in a stable manner.

Referring now to FIG. 4, a plurality of lower supports 14 are shown in a stacked or nesting arrangement. This stacking permits efficient storage of the lower supports.

Referring now to FIGS. 5 and 10, a hand table 110 is illustrated in accordance with a second embodiment of the present invention. Hand table 110 is substantially identical to hand table 10, except that utensil holder 26 on upper support 112 is omitted (see FIG. 10) and a utensil holder 126 with a serving handle 133 is added to lower support 114.

In particular, FIG. 5 shows a modified lower support 114 having a utensil holder 126 extending upwardly and outwardly from foot member 162. Utensil holder 126 is formed by a pair of parallel upwardly extending wall members 132*a* and 132*b* defining a slot 135 for slidably receiving utensils therein. Serving handle 133 extends horizontally and outwardly from the free end of wall member 132*a* so that a waiter or waitress may pass the hand table to a customer.

A person can eat and drink while standing using hand table 10, 110 or by gripping handle portion 50, 150 or by gripping third leg 55 with one hand and using the other hand to eat and drink. When the user grips third leg 55, the user's forearm will support bight 52 of the lower support.

Referring now to FIGS. 6-9, a carrying rack 76 is illustrated. The carrying rack includes a platform portion 78 having five support arms 80*a*-80*e*, a base portion 82 rigidly coupled to platform portion 78, a pair of cup supports 84*a* and 84*b* rigidly coupled to platform portion 78, four hand tables 10 or 110, as discussed above, releasably coupled to arms 80*a*-80*e*, and a cup assembly 86 releasably coupled to any one of support arms 80*a*-80*e*.

Support arms 80*a*-80*e* extend generally radially outwardly from a central hub 88 and have free ends with coupling members 90*a*-90*e*, respectively. The coupling members releasably connect a hand table or a cup assembly.

Support arms 80*a*-80*e* are all substantially identical, except that support arm 80*e* is shorter than support arms 80*a*-80*d* and only has one side dish or plate holder 92*e*. Accordingly, only support arms 80*a* and 80*e* are described in detail.

Support arm 80*d* has a pair of side dish or plate holders 92*a* rigidly coupled about midway along its length. Dish holders 92*a* each have a first semicircular portion 93*a* and a second semicircular portion 93*b* for supporting a plate thereon. Semicircular portions 93*a* and 93*b* have concave upper surfaces to prevent lateral sliding of the plate thereon.

Referring now to FIG. 11, coupling member 90*a* includes a pair of upper brackets 94*a* and 94*b* and a pair of lower brackets 96*a* and 96*b*. Upper brackets 94*a* and 94*b* extend substantially horizontally and outwardly from the free end of support arm 80*a*, and prevent tilting of a hand table or cup assembly when there is an imbalance. Lower brackets 96*a* and 96*b* are L-shaped and extend parallel and spaced below upper brackets 94*a* and 94*b*. Lower brackets 96*a* and 96*b* are connected to support arm 80*a* by spacer elements 98*a* and 98*b*. As seen in FIG. 10, hand table 110 is coupled to support arm 80*a* by positioning hub member 136 and bight 152 between upper brackets 94*a* and 94*b* and lower brackets 96*a* and 96*b*.

Referring to FIG. 7, base portion 82 includes three support legs 100*a*, 100*b* and 100*c*. Support legs 100*a* and 100*b* are fixedly coupled between support arms 80*a* and 80*b* and support arms 80*c* and 80*d*, respectively. Support leg 100*c* is fixedly coupled adjacent to the free end of support arm 80*e*.

As seen in FIG. 8, coupling member 90*e* of support arm 80*e* is substantially identical to coupling member 90*a*, discussed above, except that lower brackets 96*e* are fixedly coupled to support leg 100*c* instead of using a pair of spacer elements. Thus, support leg 100*c* holds lower brackets 96*e* parallel to and spaced below upper brackets 94*e* for receiving a hand table 10 or 110, or a cup assembly 86 therebetween.

Cup supports 84*a* and 84*b* are substantially identical. Therefore, only cup support 84*a* will be discussed in detail.

Cup support 84*a* includes a bottom support 100*a* rigidly coupled to the free end of support leg 100*a* for supporting the bottom of cup 118*a* and for adding additional stability to support leg 100*a*, and a side support 102*a*. Side support 102*a* includes a horizontal brace member 103 with a generally circular opening 104 extending therethrough for receiving cup 118*a*. Horizontal brace 103 is rigidly coupled to the platform by extension member 105*a*. Thus, side supports 102*a* and 102*b* are aligned and spaced vertically above bottom supports 101*a* and 101*b*, respectively.

Referring now to FIG. 9, cup assembly 86 is shown and includes a planar central portion 106 having a pair of generally L-shaped bottom cup supports 107*a* and 107*b* extending downwardly and outwardly from opposite ends of central portion 106. A pair of generally L-shaped side supports 108*a* and 108*b* also depend from central portion 106 and have central cup openings 109*a* and 109*b*. Cup assembly 86 is preferably releasably coupled to support arm 80*e*, although it can be coupled to any one of support arms 80*a*–80*e* as desired by resting central portion 106 on the lower brackets of the selected support arm.

In using the carrying rack 76, the waiter or waitress will grasp leg 100*c* and rest central hub 88 on his/her forearm. This allows the waiter or waitress to carry the carrying rack 76 in one hand. The carrying rack is also designed to be stackable.

Figure 14:
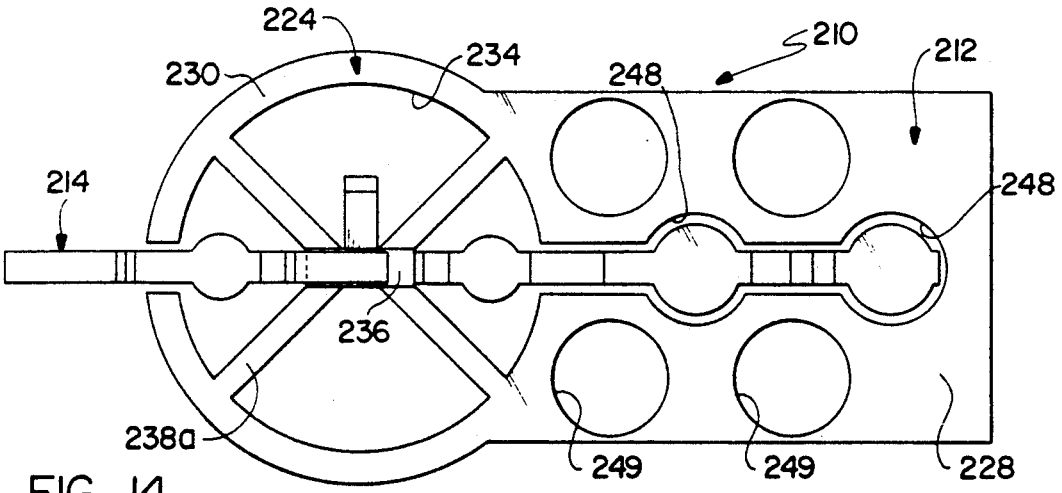
FIG. 14 is a top plan view of a hand table in accordance with a third embodiment of the present invention.
Figure 15:
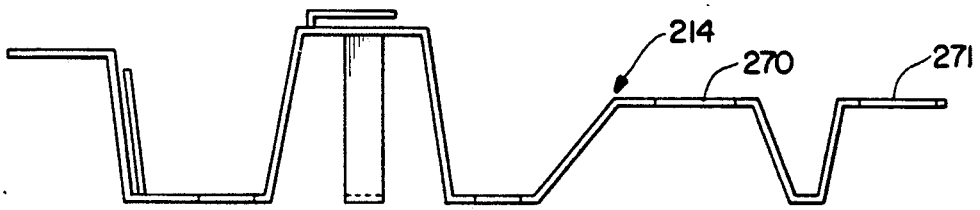
FIG. 15 is a side elevational view of the lower support of FIG. 14.

FIGS. 14 and 15 illustrate a third embodiment of the present invention which permits carrying several side dishes and two cups or glasses in one hand. A hand table 210 includes an upper support 212 and lower support 214 releasably coupled to upper support 212.

Upper support 212 includes a generally circular plate support 224. An upper cup and side dish support 228 is also integrally formed with and extends horizontally from plate support 224.

Plate support 224 has a generally planar and annular rim portion or member 230 surrounding an opening 234, and a hub member 236 positioned in the center of opening 234 and coupled to rim portion 230 by four spokes or ribs 238*a*. Spokes 238*a* are curved and extend generally radially from hub member 236 to form an upwardly concave plate supporting area.

Support 228 is a generally rectangular planar portion having cup openings 248 extending therethrough for receiving cups or glasses. Side dish openings 249 for retaining side dish plates are also provided.

Lower support 214 is formed similarly to lower support 114, but with an additional cup support 271 extending outwardly from cup support 270. The remaining structure of lower support 214 is adequately described in connection with lower supports 14 and 114.

While various embodiments of the invention have been chosen to illustrate the invention, it will be understood by those skilled in the art that various changes and modifications can be made therein without departing from the scope of the invention as defined in the appended claims.

What is claimed is:

1. A carrying rack for supporting plates and cups, the combination comprising:
   - a platform portion having a hub and a plurality of support arms extending radially from said hub, each of said support arms having at least one side dish support;
   - a base portion coupled to said platform portion for supporting said platform portion above a surface;
   - a plurality of cup supports coupled to said platform portion between adjacent pairs of said support arms;
   - a plurality of hand tables releasably coupled to said platform portion; and
   - connecting means, located at free ends of said support arms, for selectively coupling said hand tables thereto.

2. A carrying rack according to claim 1 wherein said side dish supports have upper concave surfaces for receiving and supporting a plate thereon.

3. A carrying rack according to claim 1 wherein said base portion includes three legs extending downwardly from said platform portion.

4. A carrying rack according to claim 1 wherein said base portion has a first leg coupled to one of said support arms, and second and third legs coupled between adjacent pairs of said support arms.

5. A carrying rack according to claim 1 wherein each of said cup supports includes a bottom support and a side support spaced vertically above said bottom support.

6. A carrying rack according to claim 5 wherein said side support includes a horizontal brace having an opening for receiving a cup therein.

7. A carrying rack according to claim 5 wherein each of said side supports includes a horizontal brace having air opening for receiving a cup therein.

8. A carrying rack according to claim 1 wherein each of said connecting means comprises a pair of lower brackets and a pair of upper brackets.

9. A carrying rack according to claim 8 wherein each of said lower brackets includes a first portion extending downwardly from one of said support arms, a second portion extending generally perpendicularly from said first portion, and a third portion extending upwardly from said second portion.

10. A carrying rack according to claim 1 wherein a removable cup assembly for supporting cups is releasably coupled to said platform portion by one of said connecting means.

11. A carrying rack according to claim 10 wherein said cup assembly includes a central connecting portion, first and second bottom supports each depending from opposite ends of said central portion, and first and second side supports depending from opposite ends of said central portion.

12. A carrying rack according to claim 1 wherein each of said hand tables includes an upper support having a generally circular plate support and a cup opening; and a lower support having a generally inverted U-shaped handle portion with a bight and first and second legs depending from said bight, first and second foot members extending outwardly from said first and second legs, respectively, and a cup support extending outwardly from said first foot member to a position directly below said cup opening.

* * * * *